US005700205A

United States Patent [19]

Sanford

[11] Patent Number: 5,700,205

[45] Date of Patent: Dec. 23, 1997

[54] SPORTS TRAINING SYSTEM

[75] Inventor: James Robert Markus Sanford, Mauriceville, Tex.

[73] Assignee: Helena Laboratories Corporation, Beaumont, Tex.

[21] Appl. No.: 655,377

[22] Filed: May 30, 1996

[51] Int. Cl.[6] ..... A63B 69/36

[52] U.S. Cl. ..... 473/232; 473/553; 473/457; 473/461; 473/463; 473/318; 473/321; 473/323

[58] Field of Search ..... 473/232, 553, 473/457, 461, 463, 231, 257, 318, 323, 321

[56] References Cited

U.S. PATENT DOCUMENTS

| | | | |
|---|---|---|---|
| 1,529,305 | 3/1925 | Gatke | 473/232 |
| 2,995,376 | 8/1961 | Leo . | |
| 3,180,308 | 4/1965 | Carroll et al. | 473/232 X |
| 3,270,564 | 9/1966 | Evans . | |
| 4,509,757 | 4/1985 | Yuhara . | |
| 4,854,585 | 8/1989 | Koch et al. . | |
| 5,082,283 | 1/1992 | Conley et al. . | |
| 5,169,151 | 12/1992 | Conley . | |
| 5,277,428 | 1/1994 | Goodwin et al. . | |
| 5,435,561 | 7/1995 | Conley . | |

*Primary Examiner*—George J. Marlo
*Attorney, Agent, or Firm*—Dorsey & Whitney

[57] ABSTRACT

A system measures and records deflection of an elongated shaft such as the shaft of a golf club and provides a trace or diagram of the swing of the club. The system includes an elongated rod, mounted to the golf club shaft, and a separate recording system. Preferably the recording system is a writing platform mounted to the golf club shaft. The recording member is biased into contact with the writing platform. During swing of the golf club, deflection of the golf club shaft causes relative movement between the writing implement and the writing platform and a trace or diagram of the golf club swing is created.

14 Claims, 4 Drawing Sheets

SPORTS TRAINING SYSTEM

BACKGROUND OF THE INVENTION

This invention relates to sports training systems, and more particularly, to a sports training system which provides a permanent record for the user. The present system has particular utility in recording deflection of a shaft such as a golf club or a racquet of the type used for tennis, racquet ball, or squash. For simplicity, the invention will be described in the context of a sports training system for golf but this explanation should not be taken as a limitation on the present invention.

In swinging a golf club, it is important to have a swing which is consistent since measures can be taken to compensate for a "consistent" swing even if the swing is not a "perfect" swing.

There are numerous sports training devices, usable for monitoring golf club swings, which are described in the patent literature. Examples are U.S. Pat. Nos. 2,995,376, to Leo; 3,270,564, to Evans; 4,509,757, to Yuhara; 4,854,585 to Koch et al; 5,082,283, to Conley et al; 5,168,151, to Conley; 5,277,428, to Goodwin; and 5,435,561 to Conley. The disclosures of each of these patents are hereby incorporated by reference.

There is also at least one golf swing training aid on the market called the Medicus Club but this training device provides only information to the extent that the golf swing is left-or-right of the center line of the swing, when viewed from a position perpendicular to the golfer. Thus the Medicus Club device does not provide a record of a complete swing.

SUMMARY OF THE INVENTION

It is thus apparent that there is a need for a different type of sports training aid, usable for example in connection with golf clubs, which provides a complete "picture" of the complete golf swing.

The present invention accomplishes these and other objectives by providing a system for recording the deflection of an elongated shaft, such as the shaft of a golf club. The present system includes a data input means, which determines, measures, or otherwise provides an indication of the deflection of the club shaft and a recording means to receive input from the data input means and record the shaft deflection.

The present invention further provides a system in which a data input means detects or otherwise provides an indication of the relative deflection of a golf club shaft, and a recording station to make a trace or record of the indication of the relative deflection of the golf club shaft.

BRIEF DESCRIPTION OF THE DRAWINGS

The foregoing advantages of the present invention, together with other advantages which may be attained by its use, will become more apparent upon reading the following detailed description of the invention taken in conjunction with the drawings.

In the drawings, wherein like reference numerals identify corresponding components.

DETAILED DESCRIPTION OF THE INVENTION

Figure 1:
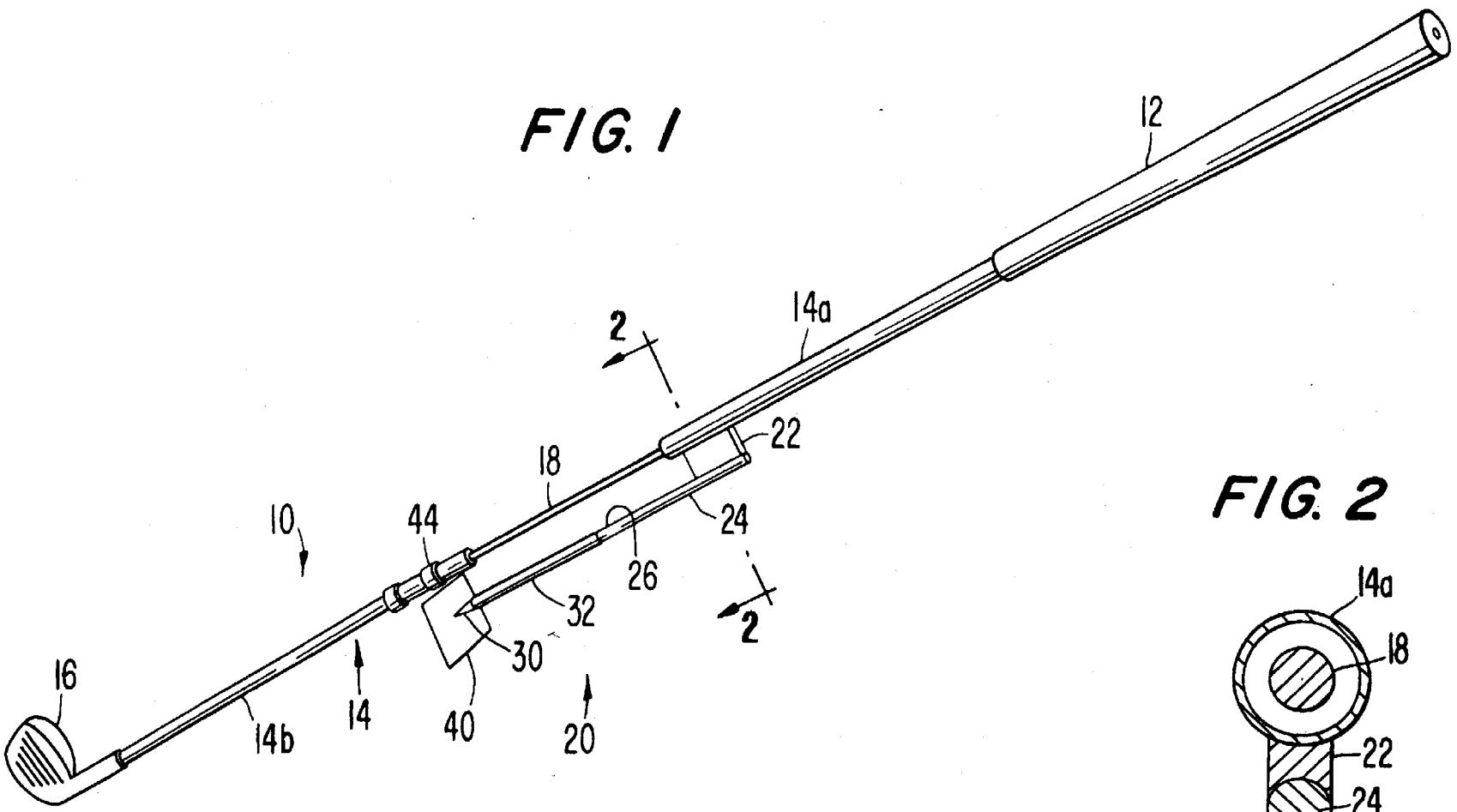
FIG. 1 is an illustration of an apparatus for recording deflection of a shaft shown attached to a golf club having a modified shaft.

With reference to the drawings, FIG. 1 is an illustration of a golf club 10 including a handle 12, an elongated shaft 14, and a head 16. The handle 12 may, of course, be covered with a material to enhance gripping of the club as is conventional. The shaft is illustrated as including two portions **14*a* and 14*b* with portion 14*a* being closer to the handle 12 and portion 14*b* being closer to the golf club head 16**.

As may be appreciated from reading the following description, it is important to properly measure the flexure or deflection of the shaft 14. However, the sports training system should not add appreciably to the overall weight of the golf club. Otherwise, the weight of the sports training aid itself will cause a difference in the manner in which the user swings the golf club. Additionally, it is important that the present invention itself does not have substantial deflection relative to the deflection of the golf club shaft. Otherwise, the deflection of the present invention might provide an inaccurate measurement of the deflection of the golf club shaft.

For these reasons, the golf club of FIG. 1 has a portion of the shaft removed and replaced with a 3/16 inch diameter spring steel rod or shaft 18 having a total length of about 14 inches and being approximately in the center or middle of the shaft 14. In positioning the shaft 18 in the middle of the shaft 14, the length of the handle 12 was not taken into consideration. The rod 18 functions as a long spring and may preferably be formed of 'music wire spring'. About 4 inches of the length of the rod or shaft 18 extends into portion **14*a* of the shaft 14 and another 4 inches of the shaft 18 extends into portion 14*b* of the shaft 14. Thus approximately 6 inches of the length of the shaft 18 is not mounted within the golf club shaft. Accordingly, approximately 6 inches of the length of the golf club shaft 14 was removed, thus the overall length of the golf club shaft has not materially changed. While the golf club shaft is hollow, as is generally known and illustrated in FIG. 2, the shaft 18 is solid. The rod 18 is positioned concentrically relative to the axis of shaft 14 when viewed from the end of the shaft (see FIG. 2) and may be secured in position by an adhesive (see FIG. 3). Thus the rod 18 is coaxially aligned along the longitudinal axis of the shaft 14. The details as given above are to exemplify the present invention and are not to be considered limitations on size, shape, configuration or materials. The use of the spring wire shaft 18 as part of the golf club shaft amplifies the deflection of the golf club shaft 14** to provide a more pronounced indication of the golf club shaft deflection.

Figure 2:
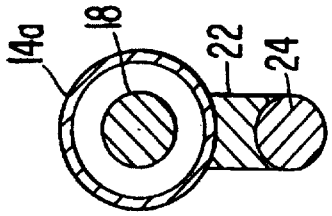
FIG. 2 is a partial cross-sectional illustration as seen in the direction of arrows 2—2 of FIG. 1, with certain parts omitted for clarity.
Figure 3:
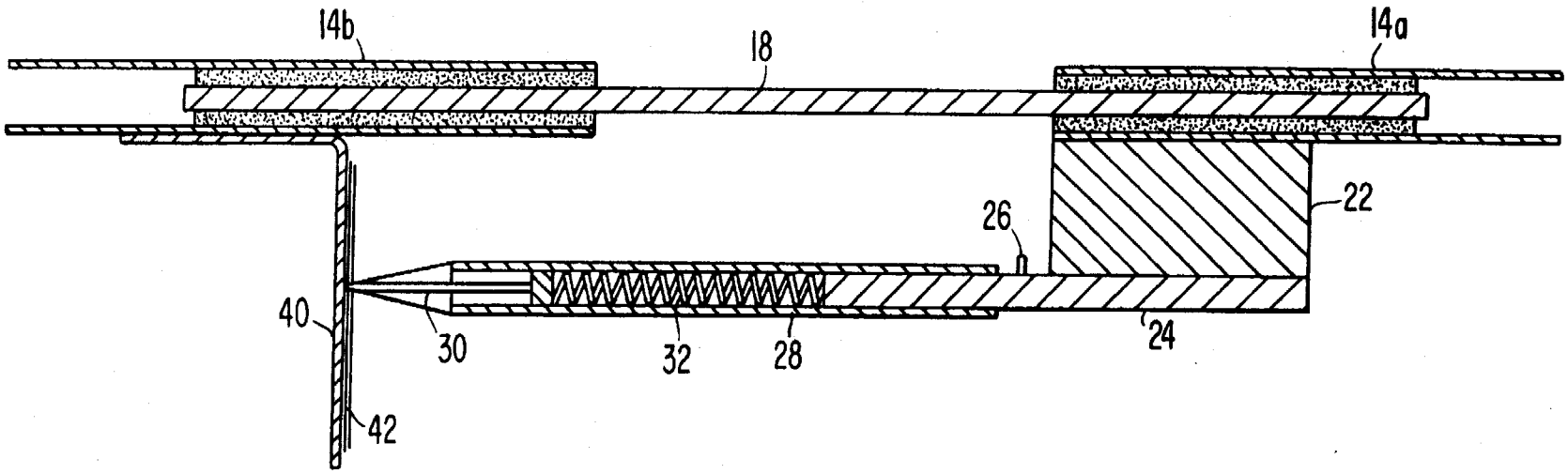
FIG. 3 is an enlarged, cross-sectional illustration of a specific feature of the apparatus for recording deflection of the shaft.
Figure 8:
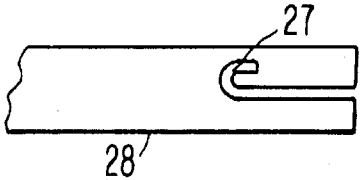
FIG. 8 is a partial illustration of a locking feature of the apparatus.

Data input means or deflection detector means 20 are provided to detect or determine deflection of the shaft 14. In the embodiment of FIG. 1, the deflection detector means 20 is parallel to the axis of the shaft 14 when viewed from the side (FIG. 1) and aligned relative to the axis of the shaft 14 when viewed from the end of the golf club (FIG. 2). The detector means includes a spacer block 22 rigidly secured to the shaft 14a above the rod 18. A second rod 24, aligned parallel to the shaft 14 as seen in lateral view, has a first end secured to the spacer block 22. A locking pin 26 is positioned intermediate the length of the rod 24. A second rod 28, which is generally hollow, has a writing or recording end 30 and an opposite end which receives the second end of the rod 24. Of course the writing end 30 may be a pencil, pen or the like. In fact the entire rod 28 may be the barrel of a pen. Means 32 are provided within rod 28 to bias the writing end 30 away from spacer block 22. Locking pin 26 cooperates with a "J"-shaped slot 27 in the rod 28 (see FIG. 8) to lock the rod 28 in a retracted position, i.e., toward spacer block 22. The purpose of spacer block 22 is to position the rod 24 and writing end 30 a predetermined distance away from shaft 18.

Figure 7:
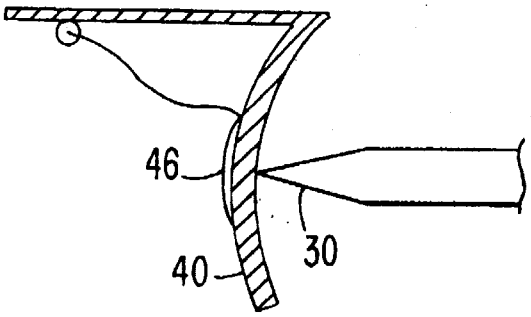
FIG. 7 is a partial side illustration of another embodiment of the apparatus.

Means are provided to record the flexure of the shaft during a swing. For this purpose, the present invention includes a platform 40 secured to the lower portion of the shaft 14b by mounting clips 44. The mounting clips, which are omitted in FIG. 3 for clarity, may be conventional 'hose' clamps or platform 40 may be attached by conventional welding, etc., to the shaft. Paper 42 may be placed on the writing platform 40. In the embodiment illustrated in FIG. 3, the platform 40 is flat. The most preferred configuration of the writing platform surface is spherical opening toward the golf club handle. A second, preferred configuration is curved in a single direction as generally illustrated in FIG. 7. A spring clip 46 biases the writing platform toward the writing instrument or writing end 30 of the detector means. The writing platform is curved to open toward the golf club handle 12. When the locking pin 26 is locked within slot 27, the writing tip is withdrawn so that paper may be replaced on the writing platform 40.

Figure 4:
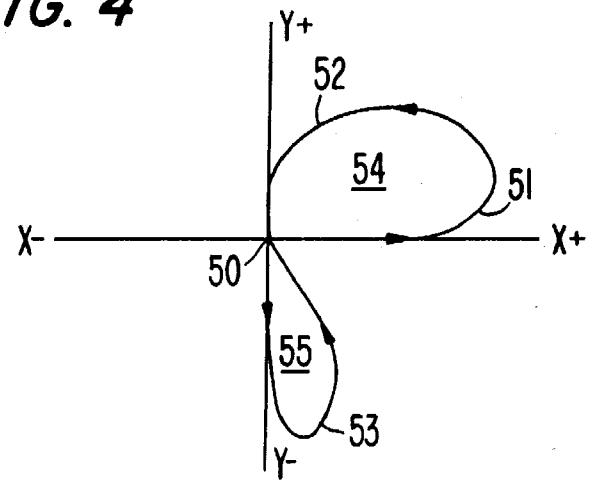
FIG. 4 is an illustration of a trace or record of a golf club swing based on the deflection of the golf club shaft.

With reference to FIG. 4, a trace or pattern of a golf club swing is illustrated. The "X" and "Y" coordinates of a graph are illustrated, with the "X" coordinate being horizontal and the "Y" coordinates vertical. As conventional, the positive "X" direction is to the right of the vertical plane and the positive "Y" direction is upward relative to the "X" plane. As shown by the arrows in the trace or curve of FIG. 4, the first portion of the back swing starts at point 50 and continues first in the positive X direction and then, at point 51, a gradual reversal in the Y direction to a point 52. Then, the trace or path becomes generally negative in the Y direction back to point 50, the origin. This represents the back swing. Thereafter, the trace continues in the negative Y direction, with no appreciable movement in the X direction, and then a gradual movement in the positive X direction to a point 53. Thereafter, the trace has a small movement in the positive X direction followed by a movement in the positive Y direction coupled with a movement negatively in the X direction back to the origin 50, where contact with the golf ball occurs if the entire swing is proper. Thus the swing trace illustrates a first portion 54 and a second portion 55; the first portion corresponding to the deflection during backswing and forward swing and the second portion 55 corresponding to continuation of the forward swing through ball contact. The "follow through" trace has been omitted for clarity. Should the vertical portion of the trace, from point 52 down to point 53, not be along the "X=0" portion of the graph, or not cross the "Y=0" portion of the graph at point 50, this would indicate an improper downswing or impact, respectively. Variations in the shape of portions 54 and 55 will indicate other deviations from the "proper" golf swing. Similarly, successive swings recorded on the same sheet of paper 42 will indicate consistency or lack of consistency in the swing.

Figure 5:
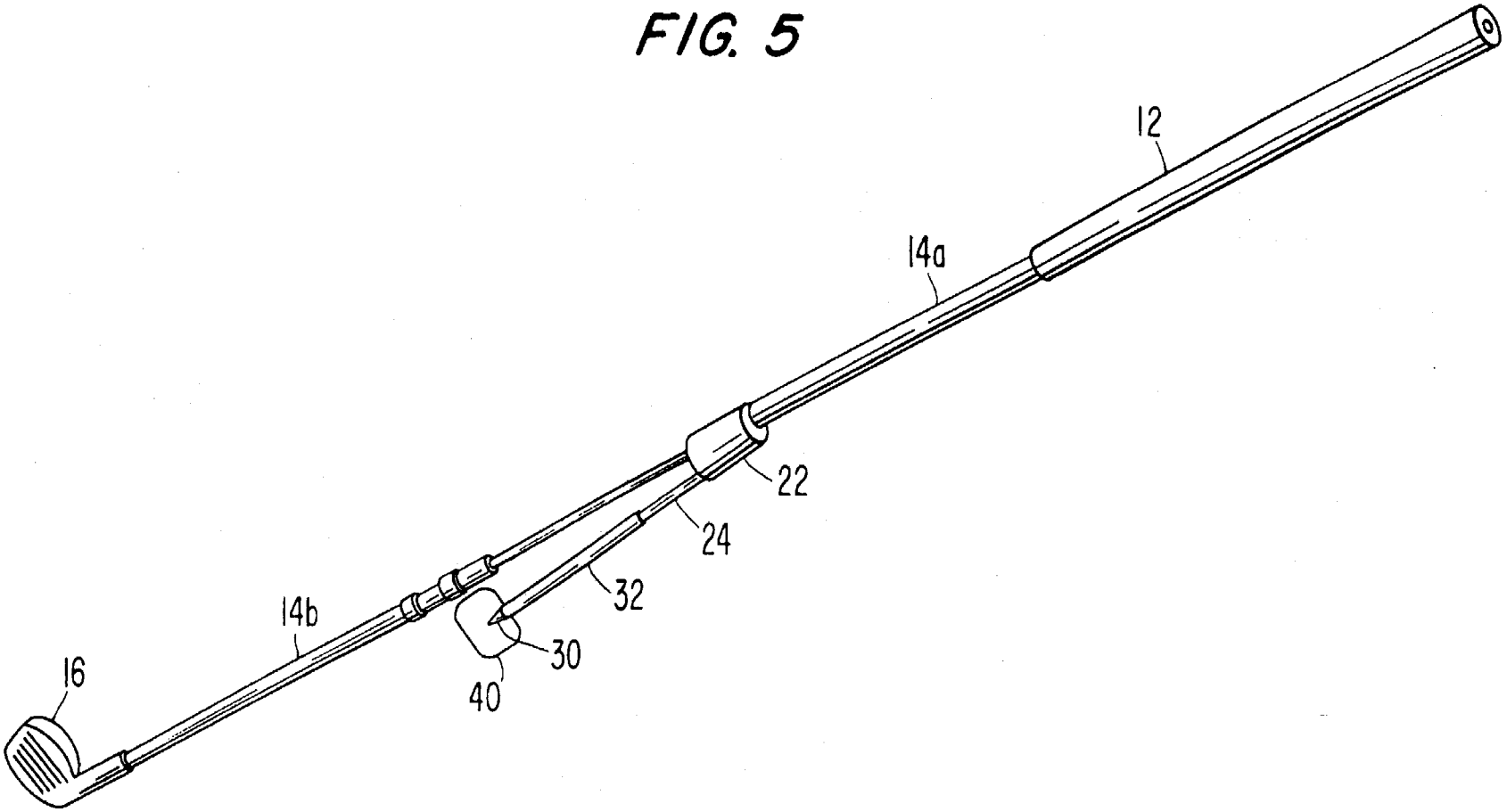
FIG. 5 illustrates a second, preferred embodiment of the apparatus for recording deflection of a shaft.

Referring next to FIG. 5 a preferred form of the invention is illustrated where the detection system including the rod 24 and pen or writing implement 30/32 having a common axis which is at an acute angle relative to the axis of the shaft 14 when viewed from the side. Of course, in the embodiment of FIG. 5 if viewed from the end of the club (i.e., the view as seen in FIG. 2), the rod 24 and pen 30 are aligned with the axis of the shaft 14. Thus the axis of rod 24 and pen 30, when viewed from the handle of the club, is directly at the club head and is neither ahead of, nor behind, the club head. The embodiment of FIG. 5 includes a modification to the spacer block 22 to accommodate the angular positioning of the rod 24.

As may be appreciated, in the embodiments of each of FIGS. 1 through 5, it may be necessary to provide a reduced diameter shaft for the golf club. It may be appreciated, however, that with graphite golf club shafts providing sufficient flexure, such a modification to the shaft may not be necessary.

Figure 6:
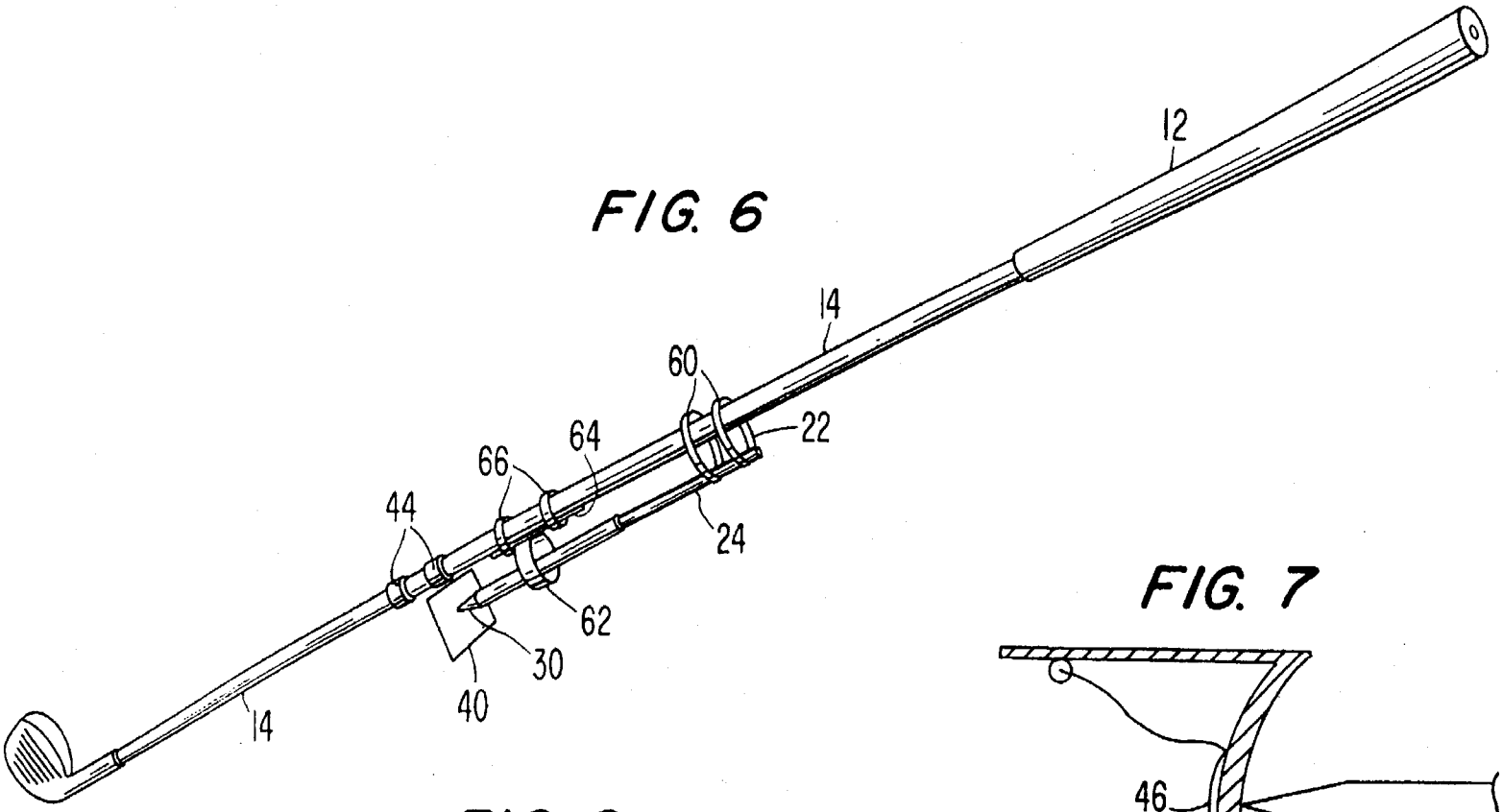
FIG. 6 illustrates an alternate embodiment of the apparatus for recording deflection of a shaft.

The invention as heretofore described includes changes to the conventional shaft 14 of a golf club and/or the potential of a permanently mounted training system. However, according to the principles of the present invention, the advantages and benefits of the present invention may be achieved without permanent modification of the golf club. Reference should now be had to FIG. 6 which illustrates a removable training system.

In the embodiment of FIG. 6, hose clamps 60 secure the spacer block 22 to the golf club shaft. An enlarged ring 62 encircles the pen 30 intermediate its ends. The ring 62 is secured to the golf club shaft by positioning a plate 64 interiorly of the ring and then clamping the plate 64 to the shaft using hose clamps 66. The purpose of the ring 62 is to limit or minimize vibrations of the pen 30 upon impact of the club head against a golf ball.

The foregoing is a complete description of the present invention. Of course the use of hose clamps has been disclosed for illustrative purposes. Various changes may be made without departing from the spirit and scope of the present invention. The present invention, therefore, should be limited only by the following claims.

What is claimed is:

1. Apparatus for recording deflection of a golf club shaft having a first axis, comprising:

deflection detecting means adapted to be mounted to said golf club shaft and to provide outputs indicative of the deflection of said golf club shaft during a golf club swing, including a back swing and a forward swing; and recording means adapted to be mounted to said golf club shaft and positioned to receive an input from said deflection detecting means indicative of the deflection of said golf club shaft during a golf club swing, including a back swing and a forward swing; and mean for biasing said deflection detecting means into contact with said recording means.

2. The invention of claim 1 wherein said deflection detection means includes an elongated rod.

3. The invention of claim 1 wherein said deflection detection means includes means for amplifying the deflection of the golf club shaft.

4. The invention of claim 1 wherein said deflection detection means includes means for amplifying the deflection of the golf club shaft and an elongated rod adapted to be mounted to said golf club shaft substantially parallel to said golf club shaft.

5. The invention of claim 1 wherein said deflection detection means has a rod, and wherein the rod has an axis aligned at an acute angle relative to the first axis of said golf club shaft when attached thereto.

6. The invention of claim 1 wherein said recording means includes a writing platform.

7. The invention of claim 1 wherein said deflection detection means is positioned parallel relative to said golf club shaft when attached thereto.

8. The invention of claim 1 wherein said deflection detection means includes means for limiting the movement of said deflection means in response to vibrations caused by impact of the golf club head.

9. The invention of claim 1 wherein said deflection detection means includes a writing implement.

10. The invention of claim 1 wherein the deflection detecting means produces an output indicative of the deflection of said golf club shaft in at least two planes.

11. The invention of claim 1 wherein said deflection detection means provides an output indicative of the deflection of the golf club shaft through an entire swing.

12. An apparatus for recording deflection of a sports equipment shaft, comprising:

deflection detecting means adapted to be mounted relative to said shaft and to provide outputs indicative of the deflection of said shaft during shaft movement; and means for biasing said detecting means into contact with said recording means;

recording means adapted to be mounted relative to said shaft and positioned to receive the outputs from said deflection detecting means and to record a pattern indicative of said shaft movement.

13. The invention of claim 12 wherein said shaft movement occurs in at least two planes.

14. The invention of claim 12 wherein said sports equipment is a golf club.

* * * * *